US009394747B2

(12) United States Patent
Bellin et al.

(10) Patent No.: US 9,394,747 B2
(45) Date of Patent: Jul. 19, 2016

(54) PCD CUTTERS WITH IMPROVED STRENGTH AND THERMAL STABILITY

(71) Applicant: Varel International Ind., L.P., Carrollton, TX (US)

(72) Inventors: Federico Bellin, Tomball, TX (US); William W. King, Houston, TX (US); James U. Nixon, Plano, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 273 days.

(21) Appl. No.: 13/917,511

(22) Filed: Jun. 13, 2013

(65) Prior Publication Data

US 2013/0333954 A1 Dec. 19, 2013

Related U.S. Application Data

(60) Provisional application No. 61/659,056, filed on Jun. 13, 2012.

(51) Int. Cl.

| | |
|---|---|
| ***E21B 10/46*** | (2006.01) |
| ***E21B 10/567*** | (2006.01) |
| ***E21B 10/573*** | (2006.01) |
| ***B24D 18/00*** | (2006.01) |
| ***B24D 99/00*** | (2010.01) |
| ***C22C 26/00*** | (2006.01) |

(52) U.S. Cl.

CPC ..... *E21B 10/5735* (2013.01); *B24D 18/00* (2013.01); *B24D 99/005* (2013.01); *C22C 26/00* (2013.01); *E21B 10/567* (2013.01)

(58) Field of Classification Search

CPC ..... E21B 10/567; E21B 10/46

See application file for complete search history.

(56) References Cited

U.S. PATENT DOCUMENTS

| | | | |
|---|---|---|---|
| 3,136,615 | A | 6/1964 | Bovenkerk et al. |
| 3,141,746 | A | 7/1964 | DeLai |
| 3,190,749 | A | 6/1965 | Fleming |
| 3,233,988 | A | 2/1966 | Wentort, Jr. et al. |

(Continued)

FOREIGN PATENT DOCUMENTS

| | | |
|---|---|---|
| EP | 0329954 | 8/1989 |
| EP | 0500253 | 8/1992 |

(Continued)

OTHER PUBLICATIONS

Copenheaver, Blaine R, International Search Report and Written Opinion of the International Searching Authority for PCT/US2013/045714, Nov. 27, 2013, pp. 1-10.

*Primary Examiner* — Catherine Loikith

(57) ABSTRACT

A thermally stable polycrystalline diamond cutter and method for fabricating the same. The cutter includes a substrate and a cutting table bonded thereto. The cutting table includes a cutting surface, a first beveled edge, a second beveled edge, a side surface, and an opposing surface that is adjacent to the substrate. The first beveled edge extends outwardly at a first angle from the cutting surface towards the substrate. The second beveled edge extends outwardly at a second angle from the first beveled edge towards the substrate. The side surface extends from the second beveled edge to the opposing surface. The cutting table is formed from a polycrystalline diamond structure having interstitial spaces disposed therebetween and a catalyst material disposed within the spaces in an untreated layer and not within a treated layer. The untreated layer includes the entire side surface.

20 Claims, 4 Drawing Sheets

(56) References Cited

U.S. PATENT DOCUMENTS

| | | | |
|---|---|---|---|
| 3,745,623 | A | 7/1973 | Wentorf, Jr. et al. |
| 4,104,344 | A | 8/1978 | Pope et al. |
| 4,108,614 | A | 8/1978 | Mitchell |
| 4,151,686 | A | 5/1979 | Lee et al. |
| 4,163,769 | A | 8/1979 | Pope et al. |
| 4,224,380 | A | 9/1980 | Bovenkerk et al. |
| 4,255,165 | A | 3/1981 | Dennis et al. |
| 4,268,276 | A | 5/1981 | Bovenkerk |
| 4,288,248 | A | 9/1981 | Bovenkerk et al. |
| 4,303,442 | A | 12/1981 | Hara et al. |
| 4,311,490 | A | 1/1982 | Bovenkerk et al. |
| 4,373,593 | A | 2/1983 | Phaal et al. |
| 4,387,287 | A | 6/1983 | Marazzi |
| 4,412,980 | A | 11/1983 | Tsuji et al. |
| 4,481,016 | A | 11/1984 | Campbell et al. |
| 4,486,286 | A | 12/1984 | Lewin et al. |
| 4,504,519 | A | 3/1985 | Zelez |
| 4,522,633 | A | 6/1985 | Dyer |
| 4,525,179 | A | 6/1985 | Gigl |
| 4,534,773 | A | 8/1985 | Phaal et al. |
| 4,556,403 | A | 12/1985 | Almond et al. |
| 4,560,014 | A | 12/1985 | Geczy |
| 4,570,726 | A | 2/1986 | Hall |
| 4,572,722 | A | 2/1986 | Dyer |
| 4,604,106 | A | 8/1986 | Hall et al. |
| 4,605,343 | A | 8/1986 | Hibbs, Jr. et al. |
| 4,606,738 | A | 8/1986 | Hayden |
| 4,621,031 | A | 11/1986 | Scruggs |
| 4,629,373 | A | 12/1986 | Hall |
| 4,636,253 | A | 1/1987 | Nakai et al. |
| 4,645,977 | A | 2/1987 | Kurokawa et al. |
| 4,662,348 | A | 5/1987 | Hall et al. |
| 4,664,705 | A | 5/1987 | Horton et al. |
| 4,670,025 | A | 6/1987 | Pipkin |
| 4,707,384 | A | 11/1987 | Schachner et al. |
| 4,726,718 | A | 2/1988 | Meskin et al. |
| 4,766,040 | A | 8/1988 | Hillert et al. |
| 4,776,861 | A | 10/1988 | Frushour |
| 4,784,023 | A | 11/1988 | Dennis |
| 4,792,001 | A | 12/1988 | Zijsling |
| 4,793,828 | A | 12/1988 | Burnand |
| 4,797,241 | A | 1/1989 | Peterson et al. |
| 4,802,539 | A | 2/1989 | Hall et al. |
| 4,807,402 | A | 2/1989 | Rai |
| 4,828,582 | A | 5/1989 | Frushour |
| 4,844,185 | A | 7/1989 | Newton, Jr. et al. |
| 4,861,350 | A | 8/1989 | Phaal et al. |
| 4,871,377 | A | 10/1989 | Frushour |
| 4,899,922 | A | 2/1990 | Slutz et al. |
| 4,919,220 | A | 4/1990 | Fuller et al. |
| 4,940,180 | A | 7/1990 | Martell |
| 4,943,488 | A | 7/1990 | Sung et al. |
| 4,944,772 | A | 7/1990 | Cho |
| 4,976,324 | A | 12/1990 | Tibbitts |
| 5,011,514 | A | 4/1991 | Cho et al. |
| 5,027,912 | A | 7/1991 | Juergens |
| 5,030,276 | A | 7/1991 | Sung et al. |
| 5,092,687 | A | 3/1992 | Hall |
| 5,116,568 | A | 5/1992 | Sung et al. |
| 5,120,327 | A | 6/1992 | Dennis |
| 5,127,923 | A | 7/1992 | Bunting et al. |
| 5,135,061 | A | 8/1992 | Newton, Jr. |
| 5,176,720 | A | 1/1993 | Martell et al. |
| 5,186,725 | A | 2/1993 | Martell et al. |
| 5,199,832 | A | 4/1993 | Meskin et al. |
| 5,205,684 | A | 4/1993 | Meskin et al. |
| 5,213,248 | A | 5/1993 | Horton et al. |
| 5,238,074 | A | 8/1993 | Tibbitts et al. |
| 5,264,283 | A | 11/1993 | Waldenstrom et al. |
| 5,337,844 | A | 8/1994 | Tibbitts |
| 5,370,195 | A | 12/1994 | Keshavan et al. |
| 5,379,853 | A | 1/1995 | Lockwood et al. |
| 5,382,314 | A | 1/1995 | Jin |
| 5,439,492 | A | 8/1995 | Anthony et al. |
| 5,464,068 | A | 11/1995 | Najafi-Sani |
| 5,468,268 | A | 11/1995 | Tank et al. |
| 5,496,638 | A | 3/1996 | Waldenstrom et al. |
| 5,499,688 | A | 3/1996 | Dennis |
| 5,500,157 | A | 3/1996 | Graebner et al. |
| 5,505,748 | A | 4/1996 | Tank et al. |
| 5,510,193 | A | 4/1996 | Cerutti et al. |
| 5,523,121 | A | 6/1996 | Anthony et al. |
| 5,524,719 | A | 6/1996 | Dennis |
| 5,544,713 | A | 8/1996 | Dennis |
| 5,560,716 | A | 10/1996 | Tank et al. |
| 5,601,477 | A | 2/1997 | Bunting et al. |
| 5,607,024 | A | 3/1997 | Keith et al. |
| 5,620,382 | A | 4/1997 | Cho et al. |
| 5,624,068 | A | 4/1997 | Waldenstrom et al. |
| 5,630,479 | A | 5/1997 | Dennis |
| 5,645,617 | A | 7/1997 | Frushour |
| 5,665,252 | A | 9/1997 | Jin et al. |
| 5,667,028 | A | 9/1997 | Truax et al. |
| 5,706,906 | A | 1/1998 | Jurewicz et al. |
| 5,718,948 | A | 2/1998 | Ederyd et al. |
| 5,722,499 | A | 3/1998 | Nguyen et al. |
| 5,776,615 | A | 7/1998 | Wong et al. |
| 5,803,196 | A | 9/1998 | Fielder |
| 5,833,021 | A | 11/1998 | Mensa-Wilmot et al. |
| 5,890,552 | A | 4/1999 | Scott et al. |
| 5,897,942 | A | 4/1999 | Karner et al. |
| 5,954,147 | A | 9/1999 | Overstreet et al. |
| 5,979,578 | A | 11/1999 | Packer |
| 6,006,846 | A | 12/1999 | Tibbitts et al. |
| 6,009,963 | A | 1/2000 | Chaves et al. |
| 6,050,354 | A | 4/2000 | Pessier et al. |
| 6,063,333 | A | 5/2000 | Dennis |
| 6,102,143 | A | 8/2000 | Snyder et al. |
| 6,123,612 | A | 9/2000 | Goers |
| 6,126,741 | A | 10/2000 | Jones et al. |
| 6,149,695 | A | 11/2000 | Adia et al. |
| 6,189,634 | B1 | 2/2001 | Bertagnolli et al. |
| 6,234,261 | B1 | 5/2001 | Evans et al. |
| 6,248,447 | B1 | 6/2001 | Griffin et al. |
| 6,253,864 | B1 | 7/2001 | Hall |
| 6,269,894 | B1 | 8/2001 | Griffin |
| 6,332,503 | B1 | 12/2001 | Pessier et al. |
| 6,344,149 | B1 | 2/2002 | Oles |
| 6,397,958 | B1 | 6/2002 | Charles et al. |
| 6,408,959 | B2 | 6/2002 | Bertagnolli et al. |
| 6,410,085 | B1 | 6/2002 | Griffin et al. |
| 6,435,058 | B1 | 8/2002 | Matthias et al. |
| 6,544,308 | B2 | 4/2003 | Griffin et al. |
| 6,585,064 | B2 | 7/2003 | Griffin et al. |
| 6,592,985 | B2 | 7/2003 | Griffin et al. |
| 6,601,662 | B2 | 8/2003 | Matthias et al. |
| 6,749,033 | B2 | 6/2004 | Griffin et al. |
| 6,878,447 | B2 | 4/2005 | Griffin et al. |
| 7,517,589 | B2 | 4/2009 | Eyre |
| 7,608,333 | B2 | 10/2009 | Eyre |
| 7,740,673 | B2 | 6/2010 | Eyre |
| 7,754,333 | B2 | 7/2010 | Eyre et al. |
| 8,147,572 | B2 | 4/2012 | Eyre et al. |
| 8,562,703 | B2 | 10/2013 | Eyre et al. |
| 2001/0037901 | A1 | 11/2001 | Bertagnolli et al. |
| 2002/0023733 | A1 | 2/2002 | Hall et al. |
| 2005/0139397 | A1 | 6/2005 | Achilles et al. |
| 2006/0042171 | A1 | 3/2006 | Radtke et al. |
| 2006/0086540 | A1 | 4/2006 | Griffin et al. |
| 2007/0181348 | A1 | 8/2007 | Lancaster et al. |
| 2008/0164071 | A1 | 7/2008 | Patel et al. |
| 2010/0243336 | A1 | 9/2010 | Dourfaye et al. |
| 2010/0266816 | A1 | 10/2010 | Eyre |
| 2010/0294571 | A1 | 11/2010 | Belnap et al. |
| 2012/0247029 | A1 | 10/2012 | Eyre et al. |

FOREIGN PATENT DOCUMENTS

| | | |
|---|---|---|
| EP | 0585631 | 3/1994 |
| EP | 0595630 | 5/1994 |
| EP | 0612868 | 8/1994 |
| EP | 0617207 | 9/1994 |
| EP | 0787820 | 8/1997 |
| EP | 0860515 | 8/1998 |

(56) References Cited

FOREIGN PATENT DOCUMENTS

| | | |
|---|---|---|
| EP | 1190791 | 3/2002 |
| GB | 1349385 | 4/1974 |
| GB | 2048927 | 12/1980 |
| GB | 2268768 | 1/1994 |
| GB | 2323398 | 9/1998 |
| RU | 2034937 | 5/1995 |
| WO | 9323204 | 11/1993 |
| WO | 9634131 | 10/1996 |
| WO | 0028106 | 5/2000 |
| WO | 2004040095 | 5/2004 |
| WO | 2004106003 | 12/2004 |
| WO | 2004106004 | 12/2004 |

PCD CUTTERS WITH IMPROVED STRENGTH AND THERMAL STABILITY

CROSS-REFERENCE TO RELATED APPLICATIONS

The present application claims priority to U.S. Provisional Patent Application No. 61/659,056, entitled "PCD Cutters With Improved Impact Strength And Thermal Stability," filed Jun. 13, 2012, the disclosure of which is incorporated by reference herein.

TECHNICAL FIELD

The present invention relates generally to cutters and methods of fabricating the cutters; and more particularly, to thermally stable polycrystalline diamond compact ("PDC") cutters and methods of forming the thermally stable polycrystalline cutters.

BACKGROUND

Polycrystalline diamond compacts ("PDC") have been used in industrial applications, including rock drilling applications and metal machining applications. Such compacts have demonstrated advantages over some other types of cutting elements, such as better wear resistance and impact resistance. The PDC can be formed by sintering individual diamond particles together under the high pressure and high temperature ("HPHT") conditions referred to as the "diamond stable region," which is typically above forty kilobars and between 1,200 degrees Celsius and 2,000 degrees Celsius, in the presence of a catalyst/solvent which promotes diamond-diamond bonding. Some examples of catalyst/solvents for sintered diamond compacts are cobalt, nickel, iron, and other Group VIII metals. PDCs usually have a diamond content greater than seventy percent by volume, with about eighty percent to about ninety-eight percent being typical. An unbacked PDC can be mechanically bonded to a tool (not shown), according to one example. Alternatively, the PDC is bonded to a substrate, thereby forming a PDC cutter, which is typically insertable within, or mounted to, a downhole tool (not shown), such as a drill bit or a reamer.

FIG. 1 shows a side view of a PDC cutter 100 having a polycrystalline diamond ("PCD") cutting table 110, or compact, in accordance with the prior art. Although a PCD cutting table 110 is described in the exemplary embodiment, other types of cutting tables, including polycrystalline boron nitride ("PCBN") compacts, are used in alternative types of cutters. Referring to FIG. 1, the PDC cutter 100 typically includes the PCD cutting table 110 and a substrate 150 that is coupled to the PCD cutting table 110. The PCD cutting table 110 is about one hundred thousandths of an inch (2.5 millimeters) thick; however, the thickness is variable depending upon the application in which the PCD cutting table 110 is to be used.

The substrate 150 includes a top surface 152, a bottom surface 154, and a substrate outer wall 156 that extends from the circumference of the top surface 152 to the circumference of the bottom surface 154. The PCD cutting table 110 includes a cutting surface 112, an opposing surface 114, a PCD cutting table outer wall 116, and a beveled edge 118. The PCD cutting table 110 includes a single beveled edge 118 that is formed at a forty-five degree angle according to FIG. 1. The beveled edge 118 extends from the circumference of the cutting surface 112 to the PCD cutting table outer wall 116. The PCD cutting table outer wall 116 is substantially perpendicular to the plane of the cutting surface 112 and extends from the outer circumference of the beveled edge 118 to the circumference of the opposing surface 114. The opposing surface 114 of the PCD cutting table 110 is coupled to the top surface 152 of the substrate 150. Typically, the PCD cutting table 110 is coupled to the substrate 150 using a high pressure and high temperature ("HPHT") press. However, other methods known to people having ordinary skill in the art can be used to couple the PCD cutting table 110 to the substrate 150. In one embodiment, upon coupling the PCD cutting table 110 to the substrate 150, the cutting surface 112 of the PCD cutting table 110 is substantially parallel to the substrate's bottom surface 154. Additionally, the PDC cutter 100 has been illustrated as having a right circular cylindrical shape; however, the PDC cutter 100 is shaped into other geometric or non-geometric shapes in other exemplary embodiments. In certain exemplary embodiments, the opposing surface 114 and the top surface 152 are substantially planar; however, the opposing surface 114 and/or the top surface 152 is non-planar in other exemplary embodiments. Additionally, according to some exemplary embodiments, the beveled edge 118 is not formed and the PCD cutting table outer wall 116 extends from the outer circumference of the cutting surface 112 to the circumference of the opposing surface 114.

According to one example, the PDC cutter 100 is formed by independently forming the PCD cutting table 110 and the substrate 150, and thereafter bonding the PCD cutting table 110 to the substrate 150. Alternatively, according to some other examples, the substrate 150 is initially formed and the PCD cutting table 110 is subsequently formed on the top surface 152 of the substrate 150 by placing polycrystalline diamond powder onto the top surface 152 and subjecting the polycrystalline diamond powder and the substrate 150 to a high temperature and high pressure process. Alternatively, in some other examples, the substrate 150 and the PCD cutting table 110 are formed and bonded together at about the same time. Although a few methods of forming the PDC cutter 100 have been briefly mentioned, other methods known to people having ordinary skill in the art can be used and are contemplated as being included within exemplary embodiments of the present invention. Further, the beveled edge 118 may be formed during fabrication of the PCD cutting table 112; however, alternatively, the beveled edge 118 may be formed once the fabrication of the PCD cutting table 112 is completed or after the PCD cutting table 112 is formed and bonded to the substrate 150.

According to one example for forming the PDC cutter 100, the PCD cutting table 110 is formed and bonded to the substrate 150 by subjecting a layer of diamond powder and a mixture of tungsten carbide and cobalt powders to HPHT conditions. The cobalt is typically mixed with tungsten carbide and positioned where the substrate 150 is to be formed. The diamond powder is placed on top of the cobalt and tungsten carbide mixture and positioned where the PCD cutting table 110 is to be formed. The entire powder mixture is then subjected to HPHT conditions so that the cobalt melts and facilitates the cementing, or binding, of the tungsten carbide to form the substrate 150. The melted cobalt also diffuses, or infiltrates, into the diamond powder and acts as a catalyst for synthesizing diamond bonds and forming the PCD cutting table 110. Thus, the cobalt acts as both a binder for cementing the tungsten carbide and as a catalyst/solvent for sintering the diamond powder to form diamond-diamond bonds. The cobalt also facilitates in forming strong bonds between the PCD cutting table 110 and the cemented tungsten carbide substrate 150.

Cobalt has been a preferred constituent of the PDC manufacturing process. Traditional PDC manufacturing processes use cobalt as the binder material for forming the substrate 150 and also as the catalyst material for diamond synthesis because of the large body of knowledge related to using cobalt in these processes. The synergy between the large bodies of knowledge and the needs of the process have led to using cobalt as both the binder material and the catalyst material. However, as is known in the art, alternative metals, such as iron, nickel, chromium, manganese, and tantalum, and other suitable materials, can be used as a catalyst for diamond synthesis. When using these alternative materials as a catalyst for diamond synthesis to form the PCD cutting table 110, cobalt, or some other material such as nickel chrome or iron, is typically used as the binder material for cementing the tungsten carbide to form the substrate 150. Although some materials, such as tungsten carbide and cobalt, have been provided as examples, other materials known to people having ordinary skill in the art can be used to form the substrate 150, the PCD cutting table 110, and form bonds between the substrate 150 and the PCD cutting table 110.

FIG. 2 is a schematic microstructural view of the PCD cutting table 110 of FIG. 1 in accordance with the prior art. Referring to FIGS. 1 and 2, the PCD cutting table 110 has diamond particles 210 bonded to other diamond particles 210, one or more interstitial spaces 212 formed between the diamond particles 210, and cobalt 214 deposited within the interstitial spaces 212. During the sintering process, the interstitial spaces 212, or voids, are formed between the carbon-carbon bonds and are located between the diamond particles 210. The diffusion of cobalt 214 into the diamond powder results in cobalt 214 being deposited within these interstitial spaces 212 that are formed within the PCD cutting table 110 during the sintering process.

Once the PCD cutting table 110 is formed and placed into operation, the PCD cutting table 110 is known to wear quickly when the temperature reaches a critical temperature. This critical temperature is about 750 degrees Celsius and is reached when the PCD cutting table 110 is cutting rock formations or other known materials. The high rate of wear is believed to be caused by the differences in the thermal expansion rate between the diamond particles 210 and the cobalt 214 and also by the chemical reaction, or graphitization, that occurs between cobalt 214 and the diamond particles 210. The coefficient of thermal expansion for the diamond particles 210 is about $1.0\times10^{-6}$ millimeters$^{-1}\times$Kelvin$^{-1}$ ("$mm^{-1}K^{-1}$"), while the coefficient of thermal expansion for the cobalt 214 is about $13.0\times10^{-6}$ $mm^{-1}K^{-1}$. Thus, the cobalt 214 expands much faster than the diamond particles 210 at temperatures above this critical temperature, thereby making the bonds between the diamond particles 210 unstable. The PCD cutting table 110 becomes thermally degraded at temperatures above about 750 degrees Celsius and its cutting efficiency deteriorates significantly.

Efforts have been made to slow the wear of the PCD cutting table 110 occurring at these high temperatures. These efforts include performing conventional acid leaching processes of the PCD cutting table 110 which removes some of the cobalt 214, or catalyst material, from the interstitial spaces 212. Conventional leaching processes involve the presence of an acid solution (not shown) which reacts with the cobalt 214, or other binder/catalyst material, that is deposited within the interstitial spaces 212 of the PCD cutting table 110. The acid solutions that have been used consist of highly concentrated solutions of hydrofluoric acid (HF), nitric acid ($HNO_3$), or sulfuric acid ($H_2SO_4$) and are subjected to different temperature and pressure conditions. According to one example of a conventional leaching process, the PDC cutter 100 is placed within such an acid solution such that at least a portion of the PCD cutting table 110 is submerged within the acid solution. The acid solution reacts with the cobalt 214, or other binder/catalyst material, along the outer surfaces of the PCD cutting table 110. The acid solution slowly moves inwardly within the interior of the PCD cutting table 110 and continues to react with the cobalt 214. During the reaction, one or more by-product materials 398 (FIG. 3) are formed. These by-product materials 398 (FIG. 3) are typically water soluble and dissolve within the solution, thereby facilitating their removal from the PCD cutting table 110 and leaving the interstitial spaces 212 empty. The leaching depth is typically about 0.1 millimeter or less. However, the leached depth can be more depending upon the PCD cutting table 110 requirements and/or the cost constraints. For example, the leaching depth can be between about 0.1 mm to 0.2 mm, or even deeper if desired. The removal of cobalt 214 alleviates the issues created due to the differences in the thermal expansion rate between the diamond particles 210 and the cobalt 214 and due to graphitization. Typically, the leaching depth extends from the cutting surface 112 to include the entire beveled edge 118 and at least a portion of the PCD cutting table outer wall 116, which also can be referred to as a cutting table side surface, as seen in FIG. 3.

FIG. 3 shows a cross-section view of a leached PDC cutter 300 having a PCD cutting table 310 that has been at least partially leached in accordance with the prior art. Referring to FIG. 3, the PDC cutter 300 includes the PCD cutting table 310 coupled to a substrate 350. The substrate 350 is similar to substrate 150 (FIG. 1) and is not described again for the sake of brevity. The substrate 350 includes a top surface 365, a bottom surface 364, and a substrate outer wall 366 extending from the perimeter of the top surface 365 to the perimeter of the bottom surface 364. The PCD cutting table 310 is similar to the PCD cutting table 110 (FIG. 1), but includes a leached layer 354 and an unleached layer 356. The leached layer 354 extends from the cutting surface 312, which is similar to the cutting surface 112 (FIG. 1), towards an opposing surface 314, which is similar to the opposing surface 114 (FIG. 1). Specifically, the leached layer 354 extends from the cutting surface 312, includes a beveled edge 318 entirely, and a portion of a PCD cutting table outer wall 376, which is similar to the PCD cutting table outer wall 116 (FIG. 1). The beveled edge 318 is similar to beveled edge 118 (FIG. 1) and is not described in detail again. In the leached layer 354, at least a portion of the cobalt 214 has been removed from within the interstitial spaces 212 (FIG. 2) using the leaching process mentioned above with one of the acids mentioned above. Thus, the leached layer 354 has been leached to a desired depth 353. However, as previously mentioned above, one or more by-product materials 398 are formed, of which very few may be deposited within some of the interstitial spaces 212 (FIG. 2) in the leached layer 354 during the leaching process. These by-product materials 398 are chemical by-products, or catalyst salts, of the dissolution reaction which are trapped within the open porosity of the interstitial spaces 212 (FIG. 2) during and/or after the dissolution process has been completed. The unleached layer 356 is similar to the PCD cutting table 150 (FIG. 1) and extends from the end of the leached layer 354 to the opposing surface 314. In the unleached layer 356, the cobalt 214 (FIG. 2) remains within the interstitial spaces 212 (FIG. 2) and has not been altered or removed. Although a boundary line 355 is formed between the leached layer 354 and the unleached layer 356 and is depicted as being substantially linear, the boundary line 355 can be non-linear in certain examples.

FIG. 4 is a schematic view of the PDC cutter 100 illustrating a bending moment 410 and a shear force 420 exerted thereon when engaged with a formation 450 in accordance with the prior art. Referring to FIG. 4, a portion of the PCD cutting table 110 that contacts the formation 450 and/or is adjacent to the portion that contacts the formation 450 is exposed to forces, such as the bending moment 410 and the shear force 420, which are caused by the interaction between the PCD cutting table 110 and the formation 450. The stresses generated within the PCD cutting table 110, as a result of the bending moment 410 and the shear force 420, may lead to the formation of cracks, especially when drilling with high weight on bit ("WOB") and rate of penetration ("ROP") in geological formations with high unconfined compressive strength ("UCS"). As seen in FIG. 4, the size of the arrows representing the bending moment 410 and the shear force 420 are depicted relatively large, when compared to those illustrated in FIG. 7, to illustrate the amount of bending moment 410 and shear force 420 that portion of the PCD cutting table 110 experiences.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
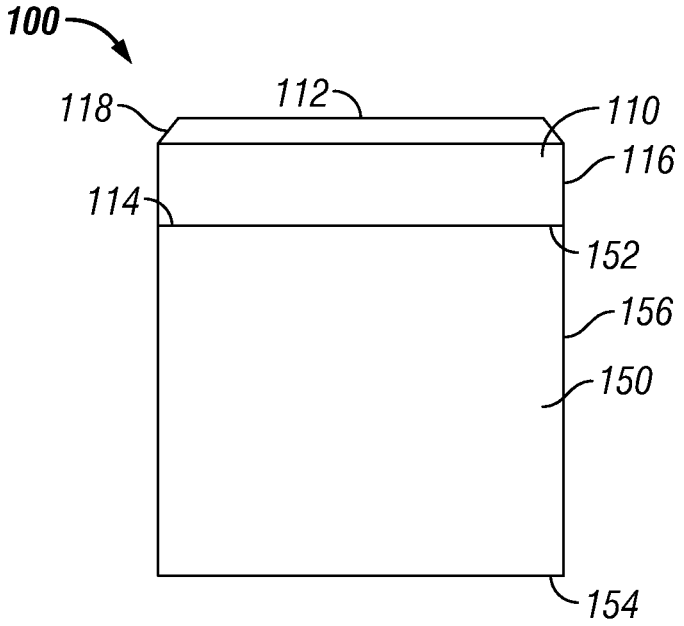
FIG. 1 (Prior Art)
FIG. 1 shows a side view of a PDC cutter having a PCD cutting table in accordance with the prior art.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed generally to cutters and methods of fabricating the cutters; and more particularly, to thermally stable polycrystalline diamond compact ("PDC") cutters and methods of forming the thermally stable polycrystalline cutters. As previously mentioned, the compact is mountable to a substrate to form a cutter or is mountable directly to a tool for performing cutting processes. The invention is better understood by reading the following description of non-limiting, exemplary embodiments with reference to the attached drawings, wherein like parts of each of the figures are identified by like reference characters, and which are briefly described as follows.

Figure 5A:
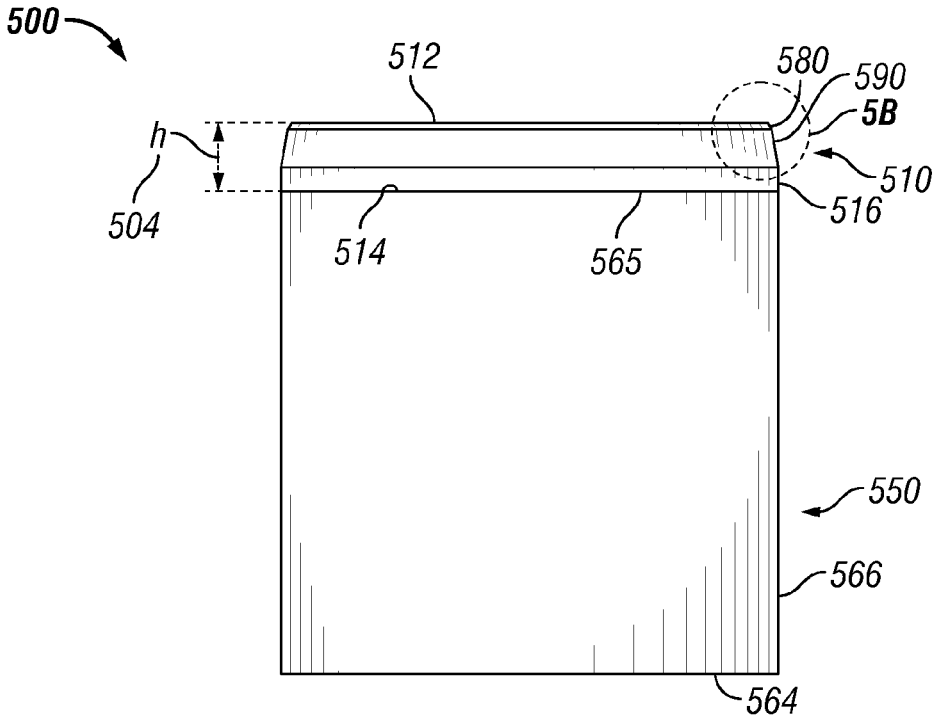
FIG. 5A shows a side view of a thermally stable PDC cutter having a PCD cutting table in accordance with an exemplary embodiment.
Figure 5B:
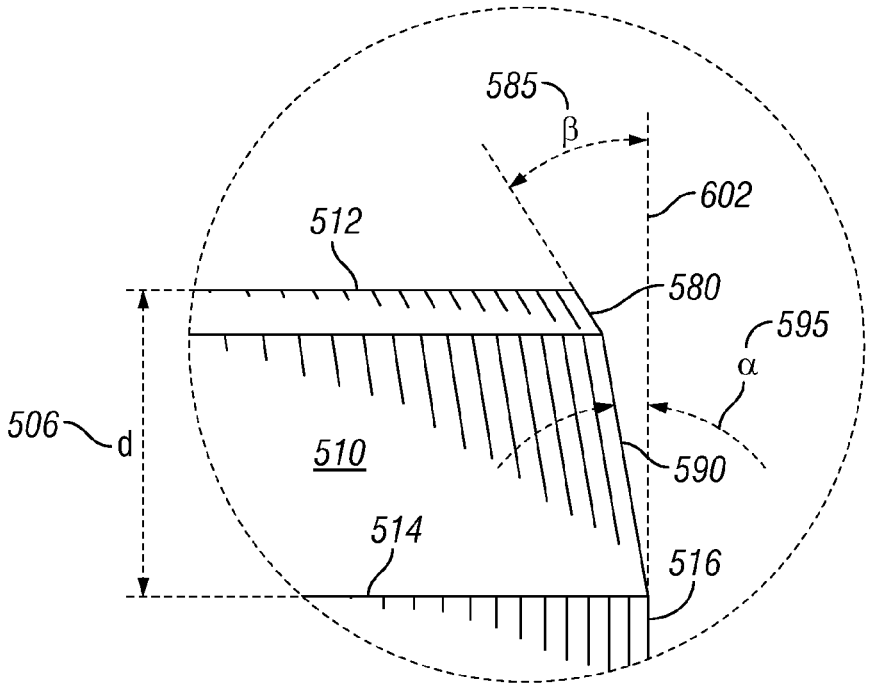
FIG. 5B shows a detailed view of a portion of the PCD cutting table of FIG. 5A in accordance with an exemplary embodiment.

FIG. 5A shows a side view of a thermally stable PDC cutter 500 having a PCD cutting table 510 in accordance with an exemplary embodiment. FIG. 5B shows a detailed view of a portion of the PCD cutting table 510 in accordance with an exemplary embodiment. Referring to FIGS. 5A and 5B, the thermally stable PDC cutter 500 includes a thermally stable polycrystalline diamond table 510 and a substrate 550 coupled to the thermally stable polycrystalline diamond table 510. The substrate 550 is similar to the substrate 150 (FIG. 1) and is therefore not described in detail again for the sake of brevity. The substrate 550 includes a top surface 565, a bottom surface 564, and a substrate outer wall 566 extending from the perimeter of the top surface 565 to the perimeter of the bottom surface 564. According to certain exemplary embodiments, the substrate 550 is cylindrically shaped.

The thermally stable polycrystalline diamond table 510 is similar to the PCD cutting table 110 (FIG. 1), but is formed having a different shape and includes a leached layer 654 (FIG. 6) and an unleached layer 656 (FIG. 6) that extend along different portions of the thermally stable polycrystalline diamond table 510, which is discussed in further detail below with respect to FIG. 6. With respect to the shape of the thermally stable polycrystalline diamond table 510, the thermally stable polycrystalline diamond table 510 includes a cutting surface 512, an opposing surface 514, a PCD cutting table outer wall 516, a first beveled edge 580, and a second beveled edge 590. Although two beveled edges 580, 590 are disclosed in the exemplary embodiment, other exemplary embodiments have greater than two beveled edges. The PCD cutting table 510 includes the first beveled edge 580 formed at a first angle β 585 measured from a vertical 602 from the cutting surface 512. The first beveled edge 580 extends outwardly at the first angle β 585 from the circumference of the cutting surface 512 towards the opposing surface 514. According to certain exemplary embodiments, the first angle β 585 is equal to or greater than forty-five degrees, but less than ninety degrees. However, in other exemplary embodiments, the first angle β 585 ranges between, and is non-inclusive of, zero degrees and ninety degrees. The PCD cutting table 510 also includes the second beveled edge 590 formed at a second angle α 595 measured from the vertical 602 from the cutting surface 512. The second beveled edge 590 extends outwardly at the second angle α 595 from the outer circumference, or end, of the first beveled edge 580 to the cutting table outer wall 516, which also can be referred to as a side surface and is oriented substantially perpendicular to the cutting surface 512. According to certain exemplary embodiments, the second angle α 595 is between, and inclusive of, one degree and four degrees. However, in other exemplary embodiments, the second angle α 595 ranges between, and is non-inclusive of, zero degrees and ninety degrees. In one example, the second angle α 595 ranges between, and is inclusive of, four degrees and ten degrees. According to certain exemplary embodiments, the value of one of the first angle β 585 or the second angle α 595 limits the value of the other angle α 595 or β 585. The cutting table outer wall 516, or side surface, extends from the outer circumference, or end, of the second beveled edge 590 to the opposing surface 514.

The PCD cutting table 510 is about one hundred thousandths of an inch (2.5 millimeters) thick in height h 504; however, the thickness in height h 504 is variable depending upon the application in which the PCD cutting table 510 is to be used, which is similar to the PCD cutting table 110 (FIG.

1). Further, the first and second beveled edges 580, 590 collectively extend a depth d 506 from the cutting surface 512 to the cutting table outer wall 516, or side surface. According to certain exemplary embodiments, the depth d 506 is greater than zero inches and less than or equal to ninety percent of the height h 504. In certain exemplary embodiments, the depth d 506 is greater than zero inches and less than 0.050 inches. In certain exemplary embodiments, the depth d 506 is greater than zero inches and less than 0.040 inches. In certain exemplary embodiments, the depth d 506 is greater than zero inches and less than 0.030 inches. Further, according to some exemplary embodiments, the depth of the first beveled edge 580 is less than the depth of the second beveled edge 590, while in other exemplary embodiments, the depth of the first beveled edge 580 is equal to or greater than the depth of the second beveled edge 590.

Figure 6:
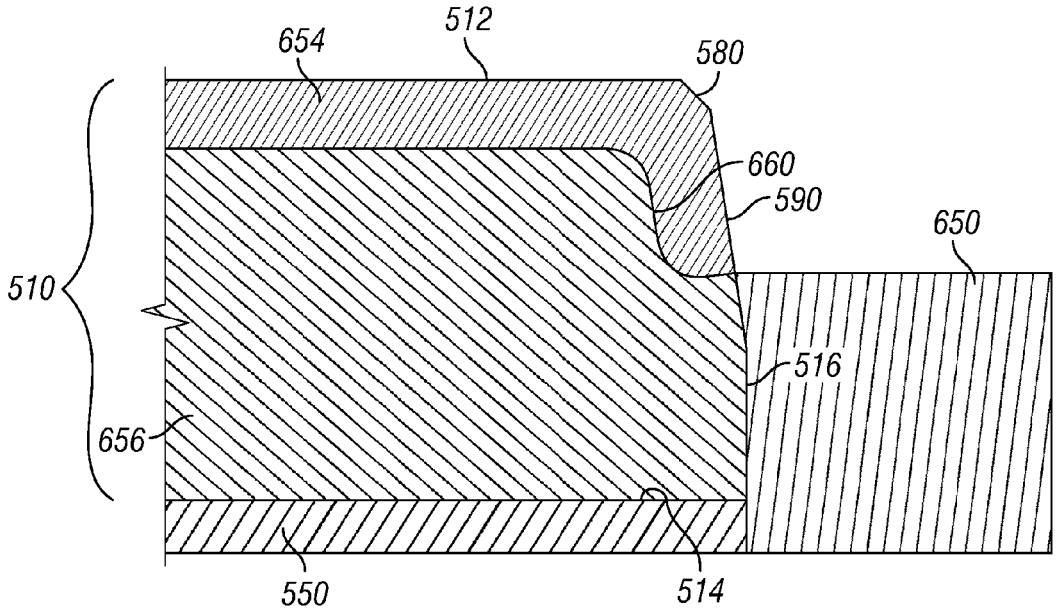
FIG. 6 shows a partial cross-sectional view of the thermally stable PDC cutter of FIG. 5A illustrating the leached layer therein in accordance with an exemplary embodiment.

FIG. 6 shows a partial cross-sectional view of the thermally stable PDC cutter 500 of FIG. 5A illustrating the leached layer 654 therein in accordance with an exemplary embodiment. Referring to FIG. 6, the leached layer 654 extends inwardly into the PCD cutting table from the cutting surface 512, the first beveled edge 580, and at least a portion of the second beveled edge 590. Accordingly, in certain exemplary embodiments, the leached layer 654 extends inwardly into the PCD cutting table 510 from the cutting surface 512, the first beveled edge 580, and at least a portion of the second beveled edge 590 to a depth of 0.1 millimeters or less, but greater than zero millimeters. Alternatively, in other exemplary embodiments, the leached layer 654 extends inwardly into the PCD cutting table 510 from the cutting surface 512, the first beveled edge 580, and at least a portion of the second beveled edge 590 to a depth of 0.5 millimeters or less, but greater than zero millimeters. Further, according to certain exemplary embodiments, the leached layer 654 extends continuously from the surface of the cutting surface 512, to the surface of the first beveled edge 580, and to the portion of the surface of the second beveled edge 590. According to some exemplary embodiments, one or more portions of the cutting surface 512, the first beveled edge 580, and/or the second beveled edge 590 are protected, or covered, such as for example by a sleeve 650, a masking (not shown), or an o-ring (not shown), during the leaching process so that the entire surface of one or more of the cutting surface 512, the first beveled edge 580, and/or the second beveled edge 590 is not part of the leached layer 654, and instead is a part of the unleached layer 656. For example, a portion of the second beveled edge 590 adjacent the cutting table outer wall 516, or side surface, the cutting table outer wall 516, and the substrate 550 is protected by the sleeve 650 during the leaching process, and which is removed after completion of the leaching process. Further, according to certain alternative exemplary embodiments, the masking may be placed along the portions of the cutting surface 512, the first beveled edge 580, and/or portions of the second beveled edge 590 so that the leached layer 654 extends non-continuously from the surface of the cutting surface 512, to the surface of the first beveled edge 580, and to the portion of the surface of the second beveled edge 590.

Figure 2:
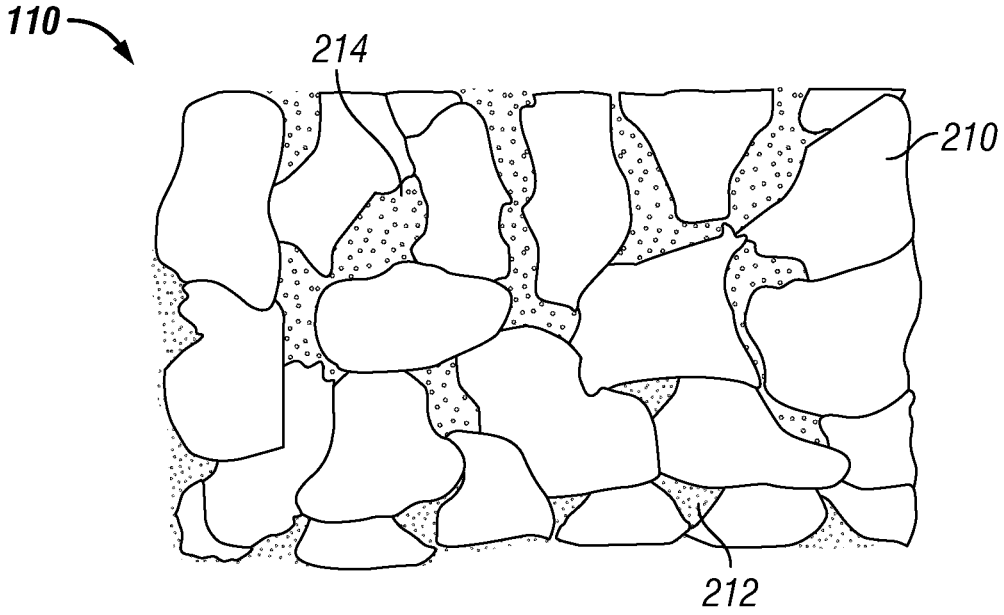
FIG. 2 (Prior Art)
FIG. 2 is a schematic microstructural view of the PCD cutting table of FIG. 1 in accordance with the prior art.
Figure 3:
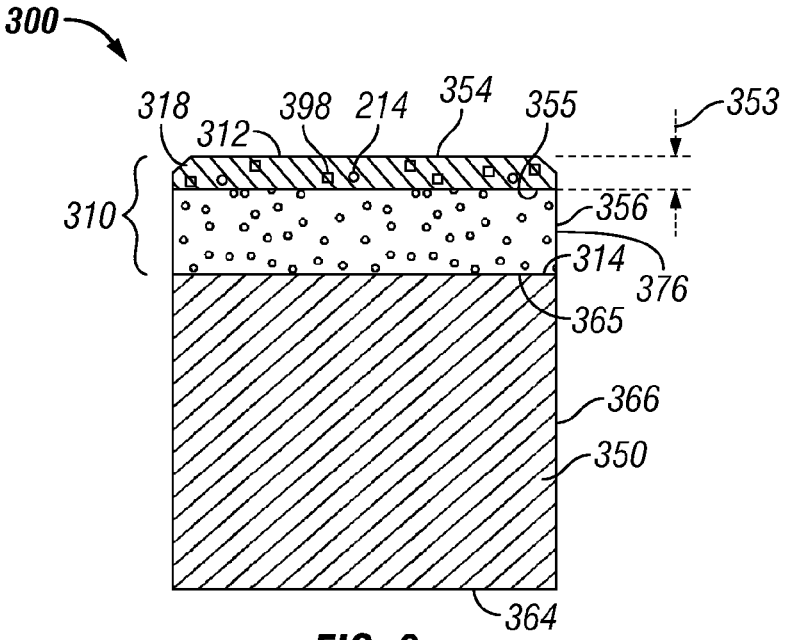
FIG. 3 (Prior Art)
FIG. 3 shows a cross-sectional view of a leached PDC cutter having a PCD cutting table that has been at least partially leached in accordance with the prior art.

The leached layer 654 has at least a portion of the catalyst material 214 (FIG. 2), such as cobalt, removed or altered so that it is more thermally stable than if the catalyst material 214 (FIG. 2) remained therein. The unleached layer 656, however, includes the catalyst material 214 (FIG. 2) therein, which has not been removed or altered by the leaching process. The unleached layer 656 extends from the end of the leached layer 654 to the opposing surface 514. Further, the surface of the cutting table outer wall 516 is included within the unleached layer 656. The boundary between the leached layer 654 and the unleached layer 656 forms a boundary line 660. This boundary line 660 is substantially non-planar within the PCD cutting table 510 in some exemplary embodiments, such as when each of the cutting surface 512, the first beveled edge 580, and at least a portion of the second beveled edge 590 is exposed to the leaching process. However, in other exemplary embodiments, the boundary line 660 is substantially planar within the PCD cutting table 510, such as when only the cutting surface 512 is exposed to the leaching process.

The leaching process is meant to include all processes that is used, or is known to be used, to remove and/or alter the catalyst material 214 (FIG. 2) within the PCD cutting table 510 to make the PCD cutting table 510 more thermally stable. For example, acid solutions, such as solutions of hydrofluoric acid (HF), nitric acid ($HNO_3$), and/or sulfuric acid ($H_2SO_4$), are used in certain leaching processes to remove and/or alter the catalyst material 214 (FIG. 2) within the PCD cutting table 510. The PCD cutting table 510 is placed in an acid solution bath, according to some exemplary embodiments, such that at least the cutting surface 512 and/or at least the cutting surface 512 and the first beveled edge 580, and/or the cutting surface 512, the first beveled edge 580, and at least a portion of the second beveled edge 590 is exposed to the acid solution bath. Alternatively, the PCD cutting table 510 is placed on a sponge (not shown) soaked in an acid solution, according to some other exemplary embodiments, such that at least the cutting surface 512 and/or at least the cutting surface 512 and the first beveled edge 580, and/or the cutting surface 512, the first beveled edge 580, and at least a portion of the second beveled edge 590 is exposed to the acid solution.

Figure 4:
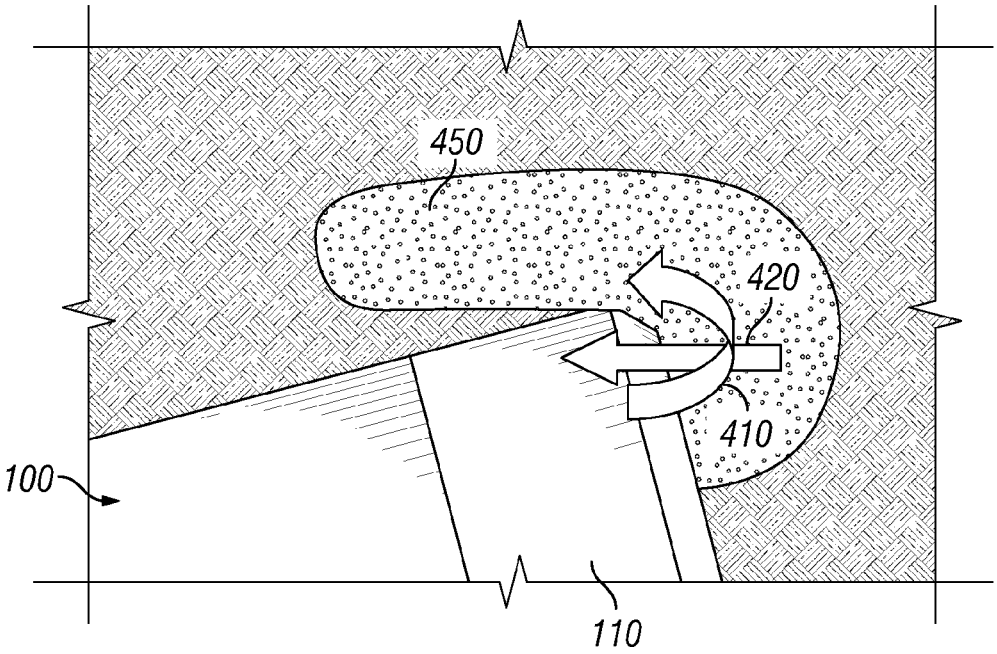
FIG. 4 (Prior Art)
FIG. 4 is a schematic view of the PDC cutter of FIG. 1 illustrating a bending moment and a shear force exerted thereon when engaged with a formation in accordance with the prior art.
Figure 7:
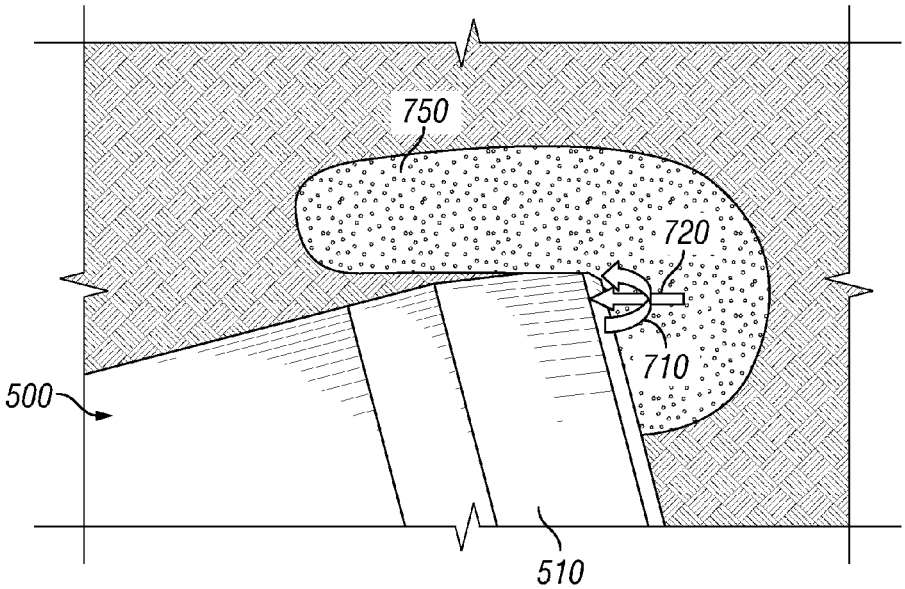
FIG. 7 is a schematic view of the thermally stable PDC cutter of FIG. 5A illustrating a bending moment and a shear force exerted thereon when engaged with a formation in accordance with an exemplary embodiment.

FIG. 7 is a schematic view of the thermally stable PDC cutter 500 illustrating a bending moment 710 and a shear force 720 exerted thereon when engaged with a formation 750 in accordance with an exemplary embodiment. Referring to FIG. 7, a portion of the PCD cutting table 510 that contacts the formation 750 and/or is adjacent to the portion that contacts the formation 750 is exposed to forces, such as the bending moment 710 and the shear force 720, which are caused by the interaction between the PCD cutting table 510 and the formation 750. According to FIG. 7, the contact point of the diamond cutting table 510 with the formation 750 is much closer to the body of the cutter 500 than the cutter 100 (FIG. 4) in the prior art. This contact point being closer to the body of the cutter 700 has the effect of reducing the bending moment 710 on the cutting edge, which is illustrated in FIG. 7 as having a smaller arrow than that depicted in FIG. 4. The contact area is greater than that of the prior art causing the stresses generated by the shear force 720 to be smaller as well. Removing the catalyst 214 (FIG. 2) from the first beveled edge 580 and a substantial length of the second beveled edge 590 increases the thermal stability of the PCD cutting table 510 engaging the formation 750 offsetting the drawback of having an increased contact area and therefore a higher amount of frictional heat being generated. The removal of catalyst 214 from at least the contact area also has the effect of lowering the friction coefficient, thereby reducing the drag force and hence lowers the shear force 720.

According to exemplary embodiments, the PDC cutter 500 includes the second beveled edge 590 allowing for better cooling, greater impact resistance, the ability to use more abrasion resistant diamond grain size due to the improved impact resistance of the double beveled edge geometry. The PDC cutter 500 allows a bit designer to use an increased back rake angle, which is more impact resistant, while maintaining the aggressiveness of the cutter tip. For instance, the backrake angle may be increased from fifteen degrees to seventeen degrees if angle $\alpha$ 595 (FIG. 5) is two degrees. The PDC cutter 500 is able to absorb increased weight on bit while benefiting from the thermal stability of the diamond in the leached second beveled edge 590 area. By increasing the backrake angle of the cutter 500, both the diamond table 510 and substrate 550 of the cutter 500 is placed into further compression rather than tension, thereby increasing the impact resistance. The bending moment 710 also is reduced on the cutting edge. The designs of the exemplary embodiments presented herein allow for an increased backrake of the leached PCD cutter 500, while maintaining the shearing aggressiveness of the cutting tip.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A method for fabricating a thermally stable polycrystalline diamond cutter, the method comprising:
- obtaining a polycrystalline diamond cutter comprising a substrate coupled to a polycrystalline diamond table, the polycrystalline diamond table formed from a polycrystalline diamond structure defining a plurality of interstitial spaces therebetween and a catalyst material disposed within one or more of the interstitial spaces and comprising:
  - a cutting surface;
  - a first beveled edge extending outwardly from a circumference of the cutting surface at a first angle towards the substrate;
  - a second beveled edge extending outwardly from a circumference of the first beveled edge at a second angle towards the substrate; and
  - a side surface extending from the circumference of the second beveled edge to the substrate; and
- removing at least a portion of the catalyst material within the polycrystalline diamond table from the cutting surface, the first beveled edge, and a first portion of the second beveled edge to a depth within an interior of the polycrystalline diamond table while protecting a second portion of the second beveled edge and an entirety of the side surface from the removal,
- wherein:
  - the first angle is greater than or equal to two times the second angle,
  - the second angle is greater than zero, and
  - each angle is measured from a vertical axis extending from the side surface.

2. The method of claim 1, wherein the second angle is less than ninety degrees.

3. The method of claim 1, wherein a length of the first beveled edge is less than a length of the second beveled edge.

4. The method of claim 3, wherein the length of the first beveled edge is less than or equal to one-half the length of the second beveled edge.

5. The method of claim 1, wherein the depth is less than 0.1 millimeters and greater than zero millimeters.

6. The method of claim 1, wherein the depth is less than 0.5 millimeters and equal to or greater than 0.1 millimeters.

7. The method of claim 1, wherein protecting the second portion of the second beveled edge and the side surface from the removal comprises placing a sleeve around at least the side surface.

8. The method of claim 7, wherein the sleeve also surrounds the second portion of the second beveled edge.

9. The method of claim 1, wherein the first angle ranges between forty-five degrees and less than ninety degrees.

10. The method of claim 1, wherein the first angle is greater than zero degrees and less than ninety degrees.

11. The method of claim 1, wherein the second angle is greater than one degree and less than four degrees.

12. A thermally stable polycrystalline cutter, comprising:
- a substrate; and
- a polycrystalline diamond table coupled to the substrate and formed with a polycrystalline diamond structure defining a plurality of interstitial spaces therebetween and a catalyst material disposed within a portion of the plurality of interstitial spaces, the polycrystalline diamond table comprising:
  - a cutting surface positioned distally away from the substrate;
  - an opposing surface positioned adjacent the substrate;
  - a first beveled edge extending outwardly from a circumference of the cutting surface at a first angle towards the substrate;
  - a second beveled edge extending outwardly from a circumference of the first beveled edge at a second angle towards the substrate;
  - a side surface extending from a circumference of the second beveled edge to the opposing surface, the side surface being substantially perpendicular to the cutting surface;
  - a treated region comprising the cutting surface, the first beveled edge, and a first portion of the second beveled edge and extending inwardly therefrom to a depth within an interior of the polycrystalline diamond table, the treated region having the catalyst material removed from the interstitial spaces; and
  - an untreated region extending from the treated region to the opposing surface, the untreated region comprising the catalyst material disposed within the interstitial spaces,
- wherein the untreated region comprises the entire side surface, a second portion of the second beveled surface, and the opposing surface,
- wherein the first angle is greater than or equal to two times the second angle,
- wherein the second angle is greater than zero, and
- wherein each angle is measured from a vertical axis extending from the side surface.

13. The thermally stable polycrystalline cutter of claim 12, wherein the depth is less than 0.1 millimeters and greater than zero millimeters.

14. The thermally stable polycrystalline cutter of claim 12, wherein the depth is less than 0.5 millimeters and equal to or greater than 0.1 millimeters.

15. The thermally stable polycrystalline cutter of claim 12, wherein the second angle is less than ninety degrees.

16. The thermally stable polycrystalline cutter of claim 12, wherein a lent of the first beveled edge is less than a length of the second beveled edge.

17. The thermally stable polycrystalline cutter of claim 16, wherein the length of the first beveled edge is less than our equal to one-half the length of the second beveled edge.

18. The thermally stable polycrystalline of claim 12, wherein the first angle ranges between forty-five degrees and less than ninety degrees.

19. The thermally stable polycrystalline of claim 12, wherein the first angle is greater than zero degrees and less than ninety degrees.

20. The thermally stable polycrystalline of claim 12, wherein the second angle is greater than one degree and less than four degrees.

* * * * *